United States Patent [19]

Quandt et al.

[11] Patent Number: 4,884,413

[45] Date of Patent: Dec. 5, 1989

[54] ICE MACHINE

[75] Inventors: James A. Quandt, Rockford, Ill.; Joseph M. Lee, Houston, Tex.

[73] Assignee: Specialty Equipment Companies, Inc., Rockton, Ill.

[21] Appl. No.: 322,510

[22] Filed: Mar. 13, 1989

[51] Int. Cl.[4] ..... F25C 1/00

[52] U.S. Cl. ..... 62/135; 62/177; 62/348

[58] Field of Search ..... 62/135, 177, 185, 201, 62/347, 348; 137/59

[56] References Cited

U.S. PATENT DOCUMENTS

| | | | |
|---|---|---|---|
| 2,593,874 | 4/1952 | Grandia | 62/348 X |
| 3,586,017 | 6/1971 | Walters | 137/59 |
| 4,550,572 | 11/1985 | Schulze-Berge | 62/138 |
| 4,694,656 | 9/1987 | Lane et al. | 62/72 |
| 4,715,194 | 12/1987 | Kito | 62/347 |
| 4,785,641 | 11/1988 | McDougal | 62/233 |

*Primary Examiner*—William E. Wayner
*Attorney, Agent, or Firm*—Vernon J. Pillote

[57] ABSTRACT

An ice making machine of the type in which an ice mold is refrigerated and water recirculated from a water receiver over the refrigerated ice mold and back to the water receiver during an ice making cycle, to freeze ice forms on the ice mold, and the ice mold is heated and water recirculation stopped during an ice harvest cycle, to release the ice forms from the ice mold. A temperature sensor senses when the water temperature in the receiver initially drops during an ice making cycle to about water freezing temperature and operates a water supply valve to supply additional water to the receiver to prevent the formation of ice slush in the water recirculation system. The amount of water added to the receiver during an ice making cycle is preferably controlled by volume. The amount of water added during the ice making cycle can also be controlled by temperature of the water in the receiver or by timing the addition of water to the receiver.

20 Claims, 2 Drawing Sheets

Fig. 3.
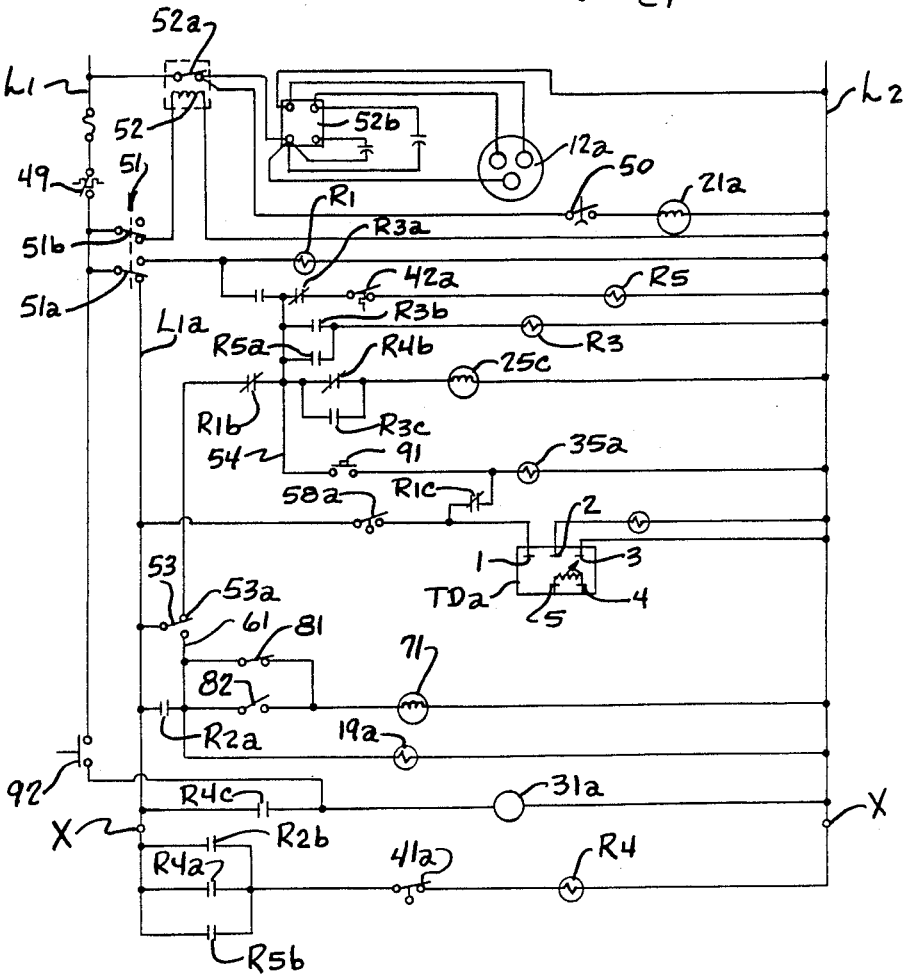
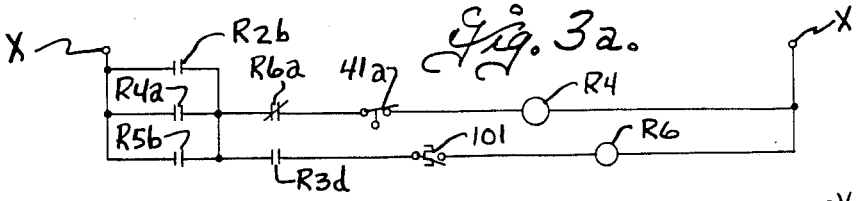
Fig. 3a.
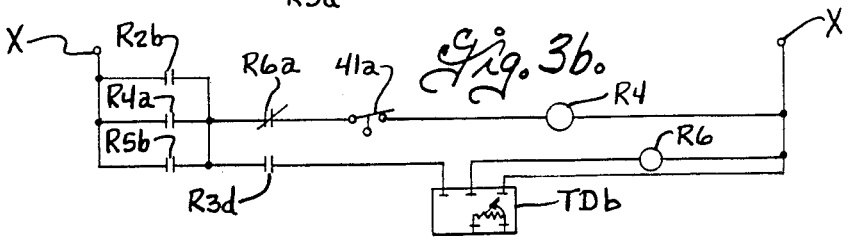
Fig. 3b.

ICE MACHINE

BACKGROUND OF THE INVENTION

The present invention relates to ice making machines of the type in which an ice mold is refrigerated and water is recirculated from a water receiver over the refrigerated ice mold and back to the water receiver during an ice making cycle, to freeze ice forms on the ice mold, and the ice mold is heated and the water recirculation stopped during an ice harvest cycle, to release the ice forms from the ice mold. At the start of the ice making cycle, the ice mold is rapidly cooled by the refrigeration apparatus to a temperature well below freezing and the water is cooled as it is recirculated over the ice mold. However, before the ice begins forming a clear ice layer on the ice mold, ice crystals are likely to start in the recirculating water and form an ice slush. The time during each ice making cycle at which ice slush begins to be formed appears to be dependent on various factors including the refrigerating capacity of the refrigeration apparatus and hence the rate at which the ice mold is cooled; the temperature of the water from the water supply used to supply an additional quantity of water at the start of each ice making cycle, and the ambient temperature. Different arrangements have heretofore been proposed for overcoming the problem of forming ice slush in an ice making machine. U.S. Pat. Nos. 4,550,572 and 4,785,641 disclose recirculation type ice making machines in which a timing device delays recirculation of water over the ice mold for a predetermined time after the start of the ice making cycle. U.S. Pat. No. 4,715,194 discloses a recirculation type ice making apparatus in which the water distributing means is arranged to leave a predetermined dry zone in which no water is distributed, for the described purpose of causing the dry zone to be somewhat colder than the remainder of the freezing surface to form an ice nucleus for the propagation of ice on the freezing surface.

SUMMARY OF THE INVENTION

It is an object of the invention to provide a recirculation type ice making machine having an improved arrangement for preventing formation of ice slush during and ice making cycle.

Accordingly, the present invention provides an ice making machine including an ice mold and means for refrigerating the ice mold during an ice making cycle and for heating the ice mold during an ice harvest cycle, a water receiver, and a water inlet valve for controlling flow of water from a water supply to the water receiver. The ice machine has a first water control for operating the water inlet valve to provide an initial quantity of water in the water receiver prior to the start of each ice making cycle, and water circulation means including a pump that is operable to withdraw water from the receiver and recirculate water over the ice mold and return unfrozen water to the receiver during the ice making cycle. A temperature sensing means senses the temperature of the water in the receiver and a second water control means is operative, when the water temperature in the receiver initially decreases to about water freezing temperature during an ice making cycle, to open and thereafter close the water inlet valve to supply additional water to the receiver. The total quantity of additional water added during an ice making cycle is substantially less than the initial quantity, and the second water control means is advantageously arranged to open and close the water inlet valve means only once during the ice making cycle.

The adding of water from the water supply to the receiver during the ice making cycle, when the temperature of the water in the receiver initially decreases to about water freezing temperature, prevents the formation of ice slush and avoids clogging of the water recirculation system and degradation of the quality and configuration of the ice formed in the ice mold.

BRIEF DESCRIPTION OF THE DRAWINGS

FIG. 3 is a schematic electrical diagram of a control circuit for the ice making machine;

FIG. 3*a* is schematic electrical diagram of modified form of water fill control; and FIG. 3*b* is a schematic diagram of another form of water fill control.

DESCRIPTION OF THE PREFERRED EMBODIMENT

Figure 1:
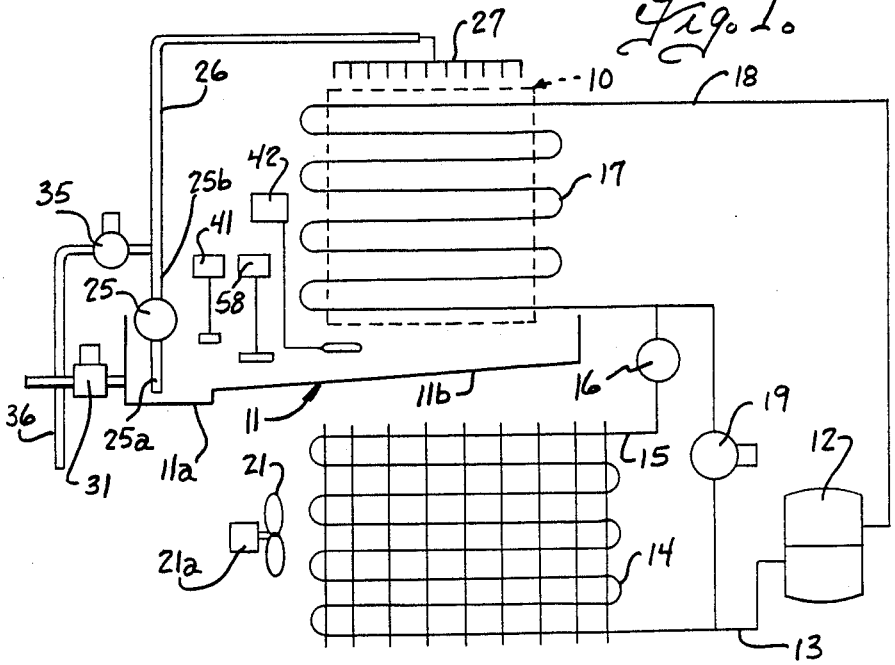
FIG. 1 is a schematic illustration of the refrigeration mechanism of an ice making machine embodying the present invention.

FIG. 1 schematically illustrates an ice making machine having an ice mold 10 with means for refrigerating the mold and means circulating water over the ice mold during an ice making cycle, to freeze ice forms on the mold, and means for heating the ice mold and stopping water recirculating during an ice harvest cycle to release the ice forms from the mold. The refrigeration apparatus is of conventional construction and includes a compressor 12 having a discharge line 13 connected to a condenser 14. A liquid line 15 from the condenser extends through a refrigerant expansion control valve 16 to an evaporator 17 disposed in heat exchange relation with the ice mold 10. A suction line 18 extends from the evaporator 15 back to the intake of the compressor 12. During the ice making cycle, gaseous refrigerant returning from the evaporator is compressed by the compressor and discharged through line 13 to the condenser 14 and liquid refrigerant from the condenser is passed through the expansion valve 16 into the evaporator to refrigerate the mold and freeze ice forms thereon. The mold is heated during the ice harvest cycle to release the ice forms from the mold. In the embodiment illustrated, a normally closed hot gas by-pass valve 19 is connected between the discharge line 13 of the compressor and the evaporator, and the by-pass valve is operative when open to direct the hot compressed gas from the compressor through the evaporator to heat the ice mold and free the ice forms from the mold. The compressor illustrated is of the air cooled type having a fan 21 that is operable to blow cooling air over the condenser.

A water receiver 11 includes a sump portion 11*a* and a portion 11*b* that extends below the ice mold 10 to receive water that drains from the ice mold and convey the water back to the sump. The water recirculation means includes a pump 25 having an inlet 25*a* that communicates with the water receiver and an outlet 25*b* connected to a pipe 26 leading to a water distributor 27 arranged to distribute water along the upper end of the ice mold for flow downwardly over the ice mold and back to the water receiver. A water inlet valve 31 is provided for controlling flow of water from a water supply line 32 such as a source of tap water, to the water receiver to provide an initial quantity of water in the water receiver. The concentration of minerals in the water in the water receiver increases as the water freezes on the ice mold and selectively operable means are provided for draining water from the receiver. In the embodiment illustrated, a discharge valve 35 is connected to the water delivery line 26 at a location to divert water from the pump 25 to a drain line 36.

The water inlet valve 31 is operated to supply an initial quantity of water in the water receiver prior to the start of an ice making cycle. During an ice making cycle, the refrigerating apparatus operates to refrigerate the ice mold 10 and the recirculation pump 25 is operated to withdraw water from the receiver and circulate the water over the ice mold and return unfrozen water from the ice mold to the receiver. At the start of the ice making cycle, the ice mold is rapidly cooled by the refrigeration apparatus to a temperature well below freezing and the water is cooled as it is recirculated over the ice mold. However, before the ice begins forming a clear layer on the ice mold, ice crystals are likely to start in the recirculating water and form an ice slush. In accordance with the invention, a temperature sensing means 42 is provided for sensing the temperature of the water in the water receiver, and a water control means responsive to the temperature sensing means is operative during each ice making cycle when the water temperature receiver initially decreases to about water freezing temperature, for opening and thereafter closing the water inlet valve 31 to supply additional water to the receiver.

A control circuit for operating the ice making machine is schematically illustrated in FIG. 3. A mode control 51 is provided for selectively operating the machine in either an ice making mode or in a wash mode and is illustrated in FIG. 3 in the ice making mode.

In the following description, it is assumed that the water receiver has been filled to a preselected level either manually or automatically and an upper liquid level sensor 41 has opened switch 41*a*, prior to the start of an ice making cycle. When the mode control 51 is in the ice making position shown in FIG. 3, switch 51*b* establishes a circuit to the compressor contact relay 52 to energize the relay and close contactors 52*a*. Relay contactors 52*a*, when closed, establish a circuit to a compressor relay 52*b* to start the drive motor 12*a* for compressor 12. It also establishes a circuit through a pressure control switch 50 to fan motor 21*a* to drive the condenser cooling fan 21 under the control of the switch 50. When the mode control 51 is in the ice making position, the mode select relay R1 is deenergized and switch 51*a* applies power from line L1 through a normally closed bin fill switch 49 to a line designated L1*a* in FIG. 3. Line L1*a* is connected through the normally closed contacts 53*a* of a harvest switch 53 and the normally closed contacts R1*b* of relay R1, to a conductor designated 54 in FIG. 3. Conductor 54 is connected through normally closed contacts R4*b* of a water fill relay R4 to the drive motor 25*c* for water pump 25 to operate the water pump and circulate water from the water receiver over the ice mold. When the water pump 25 is started, the water level in the receiver drops to a lower level, due to the water taken up in filling the pipe 26 and distributor 27 and in flowing over the ice mold but the water fill relay R4 is not re-energized until either normally relay contacts R2*b* or R5*b* are closed.

The temperature sensing means 42 includes a close-on-drop thermostat 42*a* and conductor 54 is also connected through the normally closed contacts R3*a* of a lockout relay R3 and through the normally open contacts of close-on-drop water thermostat 42*a* to a water thermostat relay R5 to energize the water thermostat relay when the temperature in the water receiver drops to substantially water freezing temperature, namely 0° C. Relay R5, when energized, closes normally open relay switch R5*a* to energize the lockout relay R3 and lockout relay closes normally open relay contacts R3*b* to maintain relay R3 energized. Relay R5, when energized, also closes normally open relay contacts R5*b* that are connected in series with a normally closed high water level switch 41*a* operated by upper liquid level senser 41, to energize a water fill relay R4. Water fill relay R4, when energized, closes normally open relay switch R4*a* to establish a holding circuit to the water fill relay and maintain the water fill relay energized until the water level again rises to open the high water level switch R41*a*. Relay R4, when energized, also closes normally open contacts R4*c* to energize water fill solenoid 19*a*. Thus, the water receiver will be supplied with an additional quantity of water sufficient to bring the water level back up to the initial water level, and compensate for the water required to fill the water pipe 26 and distributor 27 when the pump was started at the beginning of the ice making cycle. The lockout relay R3, when energized, closes normally closed contacts R3*b* to establish a holding circuit and opens normally closed relay contacts R3*a* to prevent the water thermostat from operating the water thermostat relay R5 a second time when the temperature of the water in the water receiver again drops to about water freezing temperature during the ice making cycle. Energization of lockout relay R3 also closes normally open relay contacts R3*c* to maintain the water pump energized, until the lockout relay has deactuated in the manner described hereinafter.

After a sufficient ice layer has built up on the ice mold, the ice making cycle is stopped and the ice harvesting is initiated. In the preferred embodiment disclosed, the end of the ice making cycle is sensed by a low water switch 58*a* actuated by a low water level sensor 58 arranged to sense when the water level in the receiver drops to a preselected lower level. The low water level switch 58*a* is normally open and is connected through a time delay relay TDa to an end-of-cycle relay R2. Time delay relay TDa is a delay-on-make time delay relay which is operative after power is supplied between terminals 1 and 3, to energize relay R2 connected across terminals 2 and 3, a predetermined time delay after power is applied. The time delay is adjustable by an adjustable resistor connected across terminals 4 and 5, for a preselected delay interval, for example of the order of 4 seconds. Low water level switch 58*a*, when closed, also establishes a circuit through the normally closed contacts R1*c* of mode select relay R1 to a discharge valve solenoid 35*a* to open the discharge valve 35 so that the flow of water from the pump to the water distributor 27 is stopped and the water pumped from the receiver is instead discharged to drain 36.

A predetermined time interval after closing a low water level switch 58*a*, time delay relay TDa energizes end-of-cycle relay R2 to close normally open relay contacts R2*a* and apply power from line L1*a* to a conductor designated 61 and FIG. 3. Closing of relay switch R2*a* establishes a circuit to the solenoid 19*a* for the hot gas valve 19 to open the valve and supply hot gas to the evaporator 17 to heat and defrost the same. End-of-cycle relay R2, when energized, also closes normally open contacts R2*b* to energize the water fill relay R4 through the high water level switch 41*a*, to refill the water receiver until the high water level switch opens.

Figure 2:
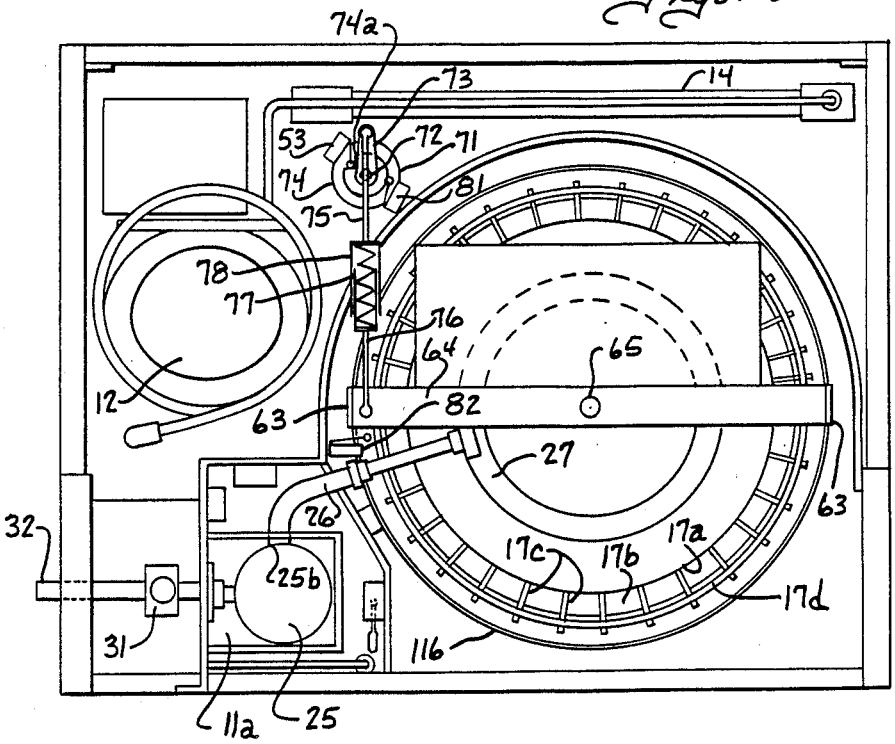
FIG. 2 is a plan view of an ice making machine.

In the preferred embodiment illustrated, the ice mold is of the type disclosed in U.S. Pat. No. 4,694,656, the disclosure of which is incorporated herein by reference. In general, and as illustrated in FIG. 2, the ice making mold disclosed in this patent includes a mold structure having a wall 17*a* that forms the base of each pocket, fins 17*b* that extend outwardly from the wall and form one pair of opposed sides of each pocket, and movable plates or blades 17*c* that extend transverse to the fins and which are movable relative to the wall and fins to aid in ejecting the ice forms from the ice mold during the harvest cycle. The freezing wall 17*a* is preferably cylindrical in form and the fins 17*b* extend generally horizontally around the freezing wall while the movable blades 17*c* extend generally vertically. A ring 17*d* engages the vertical blades 17*c* and is arranged to move the blades in different directions in response to movement of the ring. Vertical transfer bars 63 connect the ring 17*d* to a lever 64 mounted for pivotal movement about a fixed pivot 65. Harvest means are operable during the ice harvest cycle to apply a yieldable force to the plates or blades 17*c* to urge the blades from a first position shown in FIG. 2 toward a second position, to move the ice forms in the pockets relative to the surface 17*a* and fins 17*b* at the instant the ice blocks are melted free, and for thereafter returning the blades from the second back to the first position. As shown in FIG. 2, a harvest motor 71 is operative to drive a shaft 72 through a speed reducing mechanism (not shown). The shaft 72 drives a crank 73 and a cam 74. A link 75 is pivotally attached to the crank at a location spaced from the shaft 72 and a second link 76 is pivotally attached to the transfer lever 64. A spring 77 is attached to the ends of the links 75 and 76 and the spring is guided by relatively telescoping cups so that the spring can transmit both compressive and tensile forces between the links 75 and 76. The crank and cam are positioned as in FIG. 2 during the ice making cycle and cam 74 has a notch 74*a* positioned to register with the actuator on the switch 53 to allow the switch 53 to move to a position engaging its normally closed contact 53*a* as shown in FIG. 3. When the cam 74 is in the position shown in FIG. 2, the crank is arranged to position the lever 64 and hence the movable blades or plates 17*c* in the position shown in FIG. 2. A second cam switch 81 is positioned with its actuator approximately 180° from the actuator of cam 53 and a harvest switch 82 is positioned so as to be actuated by the transfer lever 64, when the transfer lever is moved to its second position. Cam switch 81 is normally open but is moved to its closed position by the cam 74 until the cam rotates through one-half revolution to bring the cam notch 74*a* into registry with the actuator for switch 81. Harvest switch 82 is normally open and is positioned so as to be moved to its closed position when the lever 64 and blades 17*c* reach their second position.

When the normally open relay contacts R2*a* are closed, power is also applied through the cam switch 81 to the harvest gear motor 71 to drive the cam 74 and lever 73 in a counterclockwise direction as viewed in FIG. 2. The lever 73 compresses the spring 77, to apply yieldable force to the lever 64. As the cam 74 rotates, it moves the switch 53 from a position engaging its normally closed contact 53*a* as shown in FIG. 2 to a position engaging its normally open contact 53*b*, to thereby continue energization of the harvest gear motor when the end-of-cycle relay R2 is deenergized and opens contacts R2*a*. The motor 71 continues rotating the shaft 72 until the cam notch 74*a* registers with the second cam switch 81, to allow the cam switch 81 to open and stop the harvest gear motor.

When the hot gas flowing through the evaporator heats the evaporator sufficient to allow release of the ice forms from the evaporator and fins, the spring 77 rapidly moves the lever 64 and blades 17*c* in a counterclockwise direction from the first position shown in FIG. 2, to a position in which the lever 64 engages the harvest switch 82 to close the normally open harvest switch and re-energize the harvest gear motor. Shaft 72 is then further rotated in a counterclockwise direction as viewed in FIG. 2 and cam switch 81 is reclosed by the cam 74 to maintain a circuit to the harvest gear motor so that the gear motor continues to rotate the shaft until the cam notch 74*a* registers with the actuator for the switch 53 to allow the switch to move from its normally open contact 53*b* back into engagement with its normally closed contact 53*a*. As the shaft 72 rotates the cam 74 back to its position shown in FIG. 3, it also moves the transfer arm 64 and blades 70*c* back to the first position shown in FIG. 2.

Movement of the switch 53 from its normally open contact back to its normally closed contact, initiates a succeeding ice making cycle. When the switch 53 moves away from its normally open contact 53*b*, it deenergizes the solenoid 19*a* to allow the hot gas valve 19 to close and return the refrigeration apparatus to a condition for refrigerating the ice mold. Movement of the switch 53 to its normally closed contact 53*a* also energizes the water pump to start recirculation of water from the water receiver over the ice mold.

When the mode control switch 51 is in the wash position as shown in FIG. 3, mode relay R1 is energized to open normally closed contacts R1*b* and R1*c* and close normally open contacts R1*a*. A manually operable purge switch 91 is connected from relay contacts R1*a* to the water discharge solenoid 35*a* to enable selective opening of the water discharge valve 35. A manually operable switch 92 is also provided to enable selective energization of the water fill solenoid 31*a* to allow opening of the water fill valve 31 in the wash mode.

From the foregoing it will be seen that the ice machine includes a first circuit including end-of-cycle relay R2, high water level sensor 41, water fill relay R4 and water fill solenoid 31*a* for operating the water control valve 31 to fill the water receiver to a preselected upper level, prior to the start of an ice making cycle. During the ice making cycle, the pump 25 circulates water from the water receiver through pipe 26 and distributor 27 over the ice mold. The liquid level in the receiver drops after the pump 25 is started and prior to the formation of ice on the ice mold, because a portion of the water is taken up in filling pipe 26 and distributor 27 and in returning over the ice mold to the receiver. When the temperature in the receiver drops to about water freezing temperature, a second water control circuit including the water thermostat 42*a*, water thermostat relay R5, high level switch R41 and water fill relay R4 are provided to add water from the water supply to the water receiver until the water level is again raised up to the initial high water level, to open switch 41*a*. Adding water to the water receiver at the time the water temperature initally drops to water freezing temperature has been found effective to prevent formation of ice slush in the water recirculation system. However, it has been found only necessary to add water at the time the water temperature initially drops to freezing temperature and the lockout relay R3 is provided to prevent reopening of the water inlet valve during the remainder of the ice making cycle. In the preferred embodiment illustrated, the duration of the ice making cycle is determined by the amount of water which is frozen on the ice mold. The low water temperature sensor 58 is arranged to close switch 58*a* when the water level drops to a preselected level below the high water level. The amount of water added during the ice making cycle corresponds generally to only a portion of the water initially supplied to the receiver, that is the portion taken up in filling up the pipe 26 and distributor 27 when the pump is started. Since the water thermostat relay refills the receiver after the start of an ice making cycle and before ice starts to freeze on the ice mold, the amount of water in the receiver between the high water level and the low water level closely reflects the amount of ice built up on the ice mold.

A modification in the apparatus for controlling addition of water during the ice making cycle is shown in FIG. 3*a*. The circuit in FIG. 3*a* is adapted to be substituted for the portion of the circuit shown in FIG. 3 below the points designated X. The circuit of FIG. 3*a* is the same as the corresponding portion of FIG. 3 except that a close-on-rise thermostat 101 is provided for sensing when the water temperature in the receiver rises to a preselected temperature, for example 3 or 4 degrees above water freezing temperature. The close-on-rise thermostat 101 is connected in series with normally open relay contacts R3*d* of lockout relay R3, and a relay R6. The normally open contacts R3*d* of Relay R3 prevent the close on rise thermostat from operating until the lockout relay R3 is energized in response to operation of the close on drop water thermostat 42*a*. Relay R6 is operative, when energized, to open normally closed relay contacts R6*a* connected in series with the water fill relay, to deenergize the water fill relay when the temperature of the water rises to a preselected level above water freezing temperature.

A further modified circuit for controlling the amount of water added during the ice making cycle is shown in FIG. 3*b*. This circuit is adapted to be substituted in the circuit of FIG. 3 for the portion of the circuit shown below the points designated X. In the modification shown in FIG. 3*b*, a delay on make time delay relay TDb is used to time the addition of water during the ice making cycle. The time delay relay TDb is connected through normally open relay contacts R3*d* of the lockout relay R3 to relay R6. Relay contacts R3*d* are closed only when the lockout relay R3 is energized in response to actuation of the water thermostat relay R5. Relay TDb is arranged to delay energization of relay R6 for a predetermined time interval that is correlated at the rate of flow through the water inlet valve 31, to supply an additional amount of water to the water receiver during an ice making cycle. Relay R6, when energized, opens normally closed contacts R6*a* connected in series with the water refill relay, to deenergize the water fill relay. The water refill relay will then remain deenergized for the remainder of the ice making cycle.

The embodiments of the invention in which an exclusive property or privilege is claimed are defined as follows:

1. In an ice making machine having an ice mold means, refrigeration means operable in an ice making mode for refrigerating the ice mold means and operable in a harvest mode for heating the ice mold means, a water receiver, water inlet valve means for controlling flow of water from a water supply to the water receiver, first water control means for operating the water inlet valve means to provide an initial quantity of water in the water receiver, water circulation means including a pump operable to withdraw water from the receiver and circulate the water over the ice mold means and return unfrozen water from the ice mold means to the receiver, circuit means for operating the refrigeration means in the ice making mode to refrigerate the ice mold means and for operating the pump to circulate water over the ice mold means for cooling and freezing thereon during an ice making cycle, circuit means for ending the ice making cycle and for operating the refrigeration means in the ice harvest mode and for stopping the pump during an ice harvest cycle, the improvement comprising, temperature sensing means for sensing the temperature of the water in the water receiver, second water control means responsive to said temperature sensing means and operative during each ice making cycle when the water temperature in the receiver initially decreases to about water freezing temperature for opening and thereafter closing water inlet valve means to supply additional water to the receiver.

2. In an ice making machine having an ice mold means, refrigeration means operable in an ice making mode for refrigerating the ice mold means and operable in a harvest mode for heating the ice mold means, a water receiver, water inlet valve means for controlling flow of water from a water supply to the water receiver, first water control means for operating the water inlet valve means to provide an initial quantity of water in the water receiver, water circulation means including a pump operable to withdraw water from the receiver and circulate the water over the ice mold means and return unfrozen water from the ice mold means to the receiver, circuit means for operating the refrigeration means in the ice making mode to refrigerate the ice mold means and for operating the pump to circulate water over the ice mold means for cooling and freezing thereon during an ice making cycle, circuit means for ending the ice making cycle and for operating the refrigeration means in the ice harvest mode and for stopping the pump during an ice harvest cycle, the improvement comprising, temperature sensing means for sensing the temperature of the water in the water receiver, second water control means responsive to said temperature sensing means and operative during each ice making cycle when the water temperature in the receiver initially decreases to about water freezing temperature for opening and thereafter closing water inlet valve means to supply additional water to the receiver, said second water control means being operative to open and close said water inlet valve means only once during each ice making cycle.

3. An ice making machine according to claim 1 wherein said second water control means is arranged to close the water inlet valve means when the liquid level in the receiver reaches a preselected upper level.

4. An ice making machine according to claim 1 wherein said first water control means includes means operative prior to each ice making cycle for opening said water inlet valve means to supply water to the receiver and for thereafter closing the water inlet valve means when the water in the receiver reaches a preselected upper level.

5. An ice making machine according to claim 4 wherein said second water control means is arranged to close the water inlet valve means when the liquid level in the receiver reaches said preselected upper level.

6. An ice making machine according to claim 1 wherein the second water control means is arranged to close the water inlet valve means when the temperature of the water in the receiver rises at least several degrees above water freezing temperature.

7. An ice making machine according to claim 1 wherein the second water control means is arranged to close the water inlet valve means a predetermined time interval after the second water control means opens the water inlet valve means.

8. In an ice making machine having ice mold means, and means for operating the machine in an ice making cycle and an ice harvest cycle, the machine including means for refrigerating the ice mold means in the ice making cycle and for heating the ice mold means in the ice harvest cycle, a water receiver, water inlet valve means for controlling flow of water from a water supply to the water receiver, first water control means for opening said water inlet valve means to supply water to the water receiver and for closing the water inlet valve when the water level in the receiver reaches a preselected upper level to provide an initial quantity of water in the water receiver at the beginning of each ice making cycle, water circulation means including pump means operable to withdraw water from the receiver and circulate water over the ice mold means and return unfrozen water to the receiver, means for operating the water circulating means during the ice making cycle and for stopping the water circulating means during the ice harvest cycle, the improvement comprising, temperature sensing means for sensing the temperature of the water in the receiver, second water control means operative only during the ice making cycle and responsive to said temperature sensing means for opening the water inlet valve means when the water temperature in the receiver initially decreases to about water freezing temperature to add water from the water supply to the water receiver, the second water control means including means for closing the water inlet valve means when the water level in the receiver reaches said preselected level.

9. An ice making machine according to claim 8 wherein said second water control means is constructed and arranged to open and close the water inlet valve means only once during each ice making cycle.

10. An ice making machine according to claim 9 wherein the means for operating the machine includes low water sensing means for sensing when the water level in the receiver decreases to a preselected lower level below said upper level, and means responsive to said low water level sensing means for ending the ice making cycle.

11. An ice making machine according to claim 8 wherein the means for operating the machine includes low water sensing means for sensing when the water level in the receiver decreases to a preselected lower level below said upper level, and means responsive to said low water level sensing means for ending the ice making cycle.

12. An ice making machine according to claim 8 wherein the means for operating the machine includes low water level sensing means actuated when the water level in the receiver decreases to a preselected lower level below said upper level, means responsive to actuation of the low water level sensing means for discharging the water from the pump means to drain to stop build-up of ice in the ice mold means, and means including time delay means responsive to actuation of the low water level sensing means for ending the ice making cycle and starting the ice harvest cycle a predetermined time interval after actuation of the low water level sensing means.

13. An ice making machine according to claim 12 including means operative at the end of the ice making cycle for operating said first water control means.

14. In an ice making machine having ice mold means and means for operating the machine in an ice making cycle and an ice harvest cycle, means for refrigerating the ice mold means in the ice making cycle and for heating the ice mold means in the ice harvest cycle, a water receiver, water inlet valve means for controlling flow of water from a water supply to the water receiver, first water control means for operating the water inlet valve means to provide an initial quantity of water in the water receiver, water circulation means including pump means operable to withdraw water from the receiver and circulate water over the ice mold means and return unfrozen water to the receiver, means for operating the water circulating means during the ice making cycle and for stopping the water circulation means during the ice harvest cycle, the improvement comprising, second water control means including means for sensing the temperature of the water in the receiver for opening the water inlet valve means when the water temperature in the receiver initially decreases to about water freezing temperature to add water from the water supply to the water receiver, the second water control means including means for closing the water inlet valve means when the water temperature in the receiver rises a few degrees above water freezing temperature.

15. In an ice making machine having ice mold means and means for operating the machine in an ice making cycle and an ice harvest cycle, means for refrigerating the ice mold means in the ice making cycle and for heating the ice mold means in the ice harvest cycle, a water receiver, water inlet valve means for controlling flow of water from a water supply to the water receiver, first water control means for operating the water inlet valve means to provide an initial quantity of water in the water receiver, water circulation means including pump means operable to withdraw water from the receiver and circulate water over the ice mold means and return unfrozen water to the receiver, means for operating the water circulating means during the ice making cycle and for stopping the water circulation means during the ice harvest cycle, the improvement comprising, second water control means including means for sensing the temperature of the water in the receiver for opening the water inlet valve means when the water temperature in the receiver initially decreases to about water freezing temperature to add water from the water supply to the water receiver, the second water control means including means for closing the water inlet valve means when the water temperature in the receiver rises a few degrees above water freezing temperature, said second water control means being constructed and arranged to open and close said water inlet valve means only once during each ice making cycle.

16. In an ice making machine having ice mold means and means for operating the machine in an ice making cycle and an ice harvest cycle, means for refrigerating the ice mold means in the ice making cycle and for heating the ice mold means in the ice harvest cycle, a water receiver, water inlet valve means for controlling flow of water from a water supply to the water receiver, first water control means for operating the water inlet valve means to provide an initial quantity of water in the water receiver, water circulation means including pump means operable to withdraw water from the receiver and circulate water over the ice mold means and return unfrozen water to the receiver, means for operating the water circulation means during the ice making cycle and for stopping the water circulation means during the ice harvest cycle, the improvement comprising, second water control means including means for sensing the temperature of the water in the receiver for opening the water inlet valve means when the water temperature in the receiver initially decreases to about water freezing temperature to add water from the water supply to the water receiver, the second water control means including means for closing the water inlet valve means a predetermined time interval after the second water control means opens the water inlet valve means.

17. In an ice making machine having ice mold means and means for operating the machine in an ice making cycle and an ice harvest cycle, means for refrigerating the ice mold means in the ice making cycle and for heating the ice mold means in the ice harvest cycle, a water receiver, water inlet valve means for controlling flow of water from a water supply to the water receiver, first water control means for operating the water inlet valve means to provide an initial quantity of water in the water receiver, water circulation means including pump means operable to withdraw water from the receiver and circulate water over the ice mold means and return unfrozen water to the receiver, means for operating the water circulation means during the ice making cycle and for stopping the water circulation means during the ice harvest cycle, the improvement comprising second water control means including means for sensing the temperature of the water in the receiver for opening the water inlet valve means when the water temperature in the receiver initially decreases to about water freezing temperature to add water from the water supply to the water receiver, the second water control means including means for closing the water inlet valve means a predetermined time interval after the second water control means opens the water inlet valve means, said second water control means being constructed and arranged to open and close said water inlet valve means only once during each ice making cycle.

18. In an ice making machine having ice mold means, and means for operating the machine in an ice making cycle and an ice harvest cycle, the machine including means for refrigerating the ice mold means in the ice making cycle and for heating the ice mold means in the ice harvest cycle, a water receiver, water inlet valve means for controlling flow of water from a water supply to the water receiver, first water control means for opening said water inlet valve means to supply water to the water receiver and for closing the water inlet valve when the water level in the receiver reaches a preselected upper level to provide an initial quantity of water in the water receiver at the beginning of each ice making cycle, water circulation means including pump means for withdrawing water from the receiver and circulating water over the ice mold means and return unfrozen water to the receiver, means for operating the water circulation means during the ice making cycle and for stopping the water circulation means during the ice harvest cycle, the improvement comprising, temperature sensing means for sensing the temperature of the water in the receiver, second water control means operative only during the ice making cycle and responsive to said temperature sensing means for opening the water inlet valve means when the water temperature in the receiver initially decreases to about water freezing temperature to add water from the water supply to the water receiver, the second water control means including means for closing the water inlet valve means when the water level in the receiver reaches said preselected upper level, and means operative during an ice making cycle when water level in the receiver drops to a preselected lower level for stopping the ice making cycle and initiating an ice harvest cycle.

19. An ice making machine according to claim 18 wherein said second water control means is constructed and arranged to open and close said water inlet valve means only once during each ice making cycle.

20. In an ice making machine having an ice mold means, refrigeration means operable in an ice making mode for refrigerating the ice mold means and operable in a harvest mode for heating the ice mold means, a water receiver, water inlet valve means for controlling flow of water from a water supply to the water receiver, first water control means for operating the water inlet valve means to provide an initial quantity of water in the water receiver, water circulation means including a pump operable to withdraw water from the receiver and circulate the water over the ice mold means and return unfrozen water from the ice mold means to the receiver, circuit means for operating the refrigeration means in the ice making mode to refrigerate the ice mold means and for operating the pump to circulate water over the ice mold means for cooling and freezing thereon during an ice making cycle, circuit means for ending the ice making cycle and for operating the refrigeration means in the ice harvest mode and for stopping the pump during an ice harvest cycle, the improvement comprising, second water control means operative during each ice making cycle when the water temperature in the receiver initially decreases to about water freezing temperature to open the water inlet valve means to supply an additional quantity of water from the water supply to the receiver and thereafter close said water inlet valve means for the remainder of the ice making cycle.

* * * * *